US006375241B1

(12) United States Patent
Sadeck

(10) Patent No.: US 6,375,241 B1
(45) Date of Patent: Apr. 23, 2002

(54) LOAD SECURING AND RELEASE SYSTEM

(75) Inventor: James E. Sadeck, East Freetown, MA (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/834,934

(22) Filed: Apr. 11, 2001

(51) Int. Cl.[7] ..... B66C 1/18
(52) U.S. Cl. ..... 294/75; 294/74
(58) Field of Search ..... 294/31.2, 74, 75, 294/82.14, 149, 150, 152, 154, 155, 157

(56) References Cited

U.S. PATENT DOCUMENTS 555,462 A * 2/1896 Morrow ..... 294/75 X
2,095,843 A * 10/1937 Sullivan ..... 294/75 X
2,825,598 A * 3/1958 Nickolai ..... 294/75
3,854,767 A * 12/1974 Burnett ..... 294/74
4,043,581 A * 8/1977 St. Germain ..... 294/74
4,350,380 A * 9/1982 Williams ..... 294/74
4,834,439 A * 5/1989 van de Kamp ..... 294/74
5,238,279 A * 8/1993 Anteau ..... 294/74

* cited by examiner

*Primary Examiner*—Johnny D. Cherry
(74) *Attorney, Agent, or Firm*—Vincent J. Ranucci

(57) ABSTRACT

A load securing and release system, comprising a load carrying elongated web element having two end sections, one end section defining a first receiving structure, the other end section engaged through the first receiving structure and releasably connected on itself by a series of terminal receiving structures, and a series of intermediate engaging structures, wherein one engaging structure is engaged through each terminal receiving structure, and wherein all but one of the engaging structures is also releasably engaged with another engaging structure, and wherein the remaining engaging structure is releasably held to the web element by a release element, to provide a mechanical advantage for carrying heavy loads.

14 Claims, 1 Drawing Sheet

LOAD SECURING AND RELEASE SYSTEM

STATEMENT OF GOVERNMENT INTEREST

This invention relates to a load securing and release system that is particularly adapted for carrying heavy loads without the use of high strength materials.

FIELD OF THE INVENTION

The invention described herein may be manufactured and used by and for the Government of the United States of America for Governmental purposes without the payment of any royalties thereon.

BACKGROUND OF THE INVENTION

Load securing and release systems such as systems that are designed to release loads from aircraft, are typically constructed from multiple layers of flat nylon webbing. When these layers of webbing are in contact with each other, at the locations where the high forces are applied, a tremendous amount of heat is generated from compression, which can result in the nylon webbing melting and therefore failing prematurely. The maximum average safe load capability of a system when constructed of layered nylon webbing is about 70,000 pounds. However, there are situations in which loads as high as 200,000 pounds need to be secured and releasable at the same time.

SUMMARY OF THE INVENTION

It is therefore an object of this invention to provide an improved load securing and release system that can secure and releasably maintain loads as high as 200,000 pounds.

This invention features in one embodiment a load securing and release system, comprising a load carrying elongated web element having two end sections, one end section defining a first receiving structure, the other end section engaged through the first receiving structure and releasably connected on itself by a series of terminal receiving structures, and a series of intermediate engaging structures, wherein one engaging structure is engaged through each terminal receiving structure, and wherein all but one of the engaging structures is also releasably engaged with another engaging structure, and wherein the remaining engaging structure is releasably held to the web element by a release element, to provide a mechanical advantage for carrying heavy loads. The web element can be a line, rope, cord, true webbing, or any other elongated woven, braided or other strong, flexible element.

The first receiving structure preferably comprises a loop in the web element. The terminal receiving structures preferably each comprise a loop in the web element. The intermediate engaging structures also preferably each comprise a loop in the web element.

The release element preferably comprises a loop in the web element. Preferably, this loop is engaged through the remaining engaging structure. The release element may further comprise an anchor loop engaged with the web element, and a sacrifice cord connecting the anchor loop and the release element loop.

The terminal receiving structures may be of gradually increasing length from the first to the distal terminal receiving structure. The intermediate engaging structures may all be part of a diverging portion of the web element. The intermediate engaging structures may each comprise a loop in the diverging portion.

In one embodiment, there are three terminal receiving structures and three intermediate engaging structures.

In a more specific embodiment, the invention features a load securing and release system, comprising a load carrying elongated web element having two end sections, one end section defining a first receiving structure comprising a loop in the web element, the other end section engaged through the first receiving structure loop and releasably connected on itself by a series of terminal receiving structures each comprising a loop in the web element and wherein the terminal receiving structures are of gradually increasing length from the first to the distal terminal receiving structure, and a series of intermediate engaging structures each comprising a loop in the web element wherein the intermediate engaging structures each comprise a loop in the diverging portion that are all part of a diverging portion of the web element, wherein one engaging structure is engaged through each terminal receiving structure, and wherein all but one of the engaging structures is also releasably engaged with another engaging structure, and wherein the remaining engaging structure is releasably held to the web element by a release element that comprises a loop in the web element that is engaged through the remaining engaging structure, and wherein the release element further comprises an anchor loop engaged with the web element and a sacrifice cord connecting the anchor loop and the release element loop, to provide a mechanical advantage for carrying heavy loads.

BRIEF DESCRIPTION OF THE DRAWING

Other objects, features and advantages will occur to those skilled in the art from the following description of the preferred embodiment and the accompanying drawing, FIG. 1, which is a side view of the preferred load securing and release system of this invention.

DETAILED DESCRIPTION OF THE PREFERRED EMBODIMENT

Figure 1:
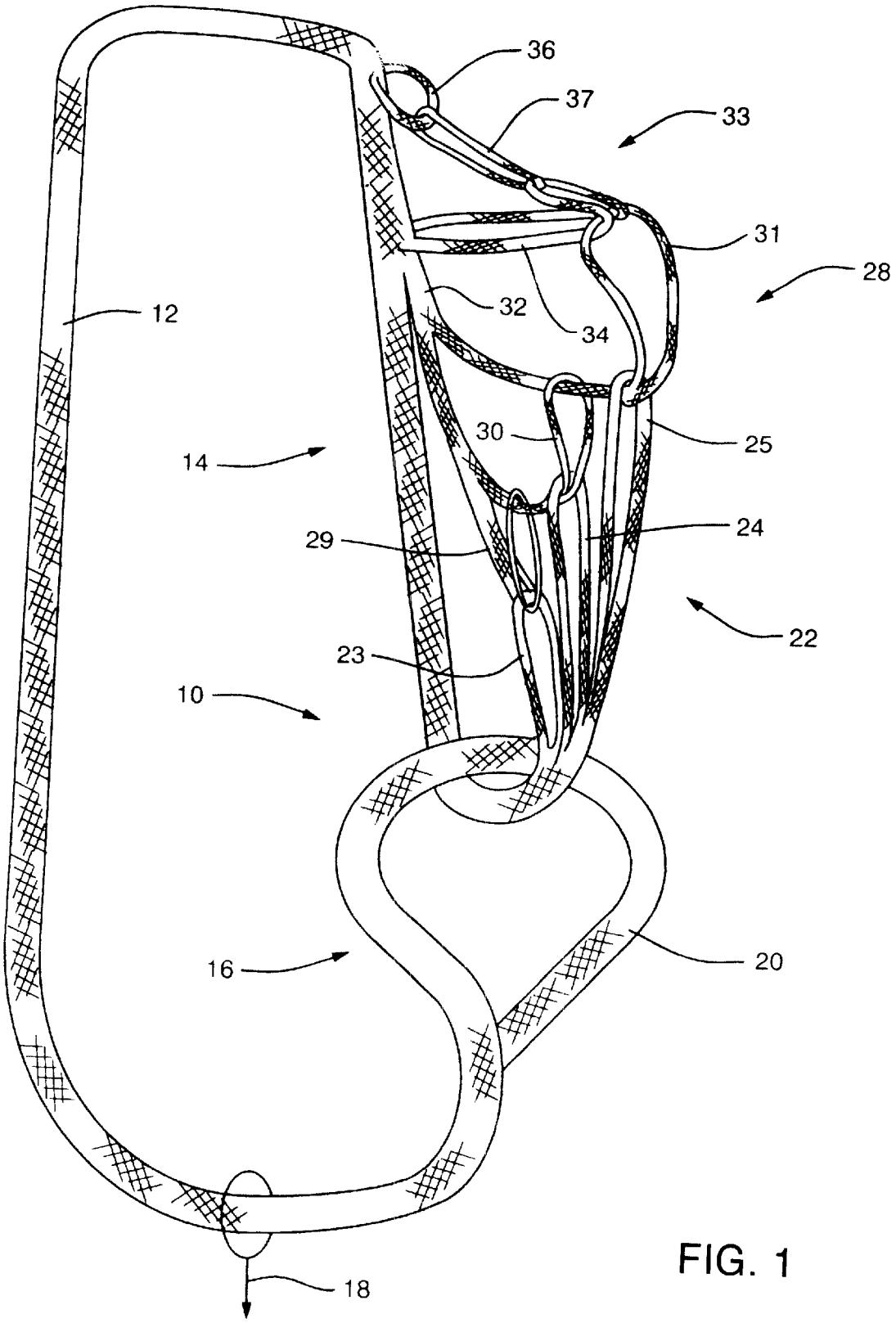

This invention features a load securing and release system comprising a load carrying elongated web element having two end sections. One end section defines a first receiving structure such as a large eye spliced into the end of the web element. The web element preferably comprises a double braided nylon rope. The other end section of the web element is engaged through this first receiving structure and releasably connected on itself by a series of terminal receiving structures and a series of intermediate engaging structures. One engaging structure is engaged through each terminal receiving structure. All but one of the engaging structures is also releasably engaged with another of the engaging structures. The remaining engaging structure is releasably held to the web element by a release element. This structure provides a substantial mechanical advantage that allows extremely heavy loads to be carried, and released when desired by parting the release element.

A preferred embodiment of the invention is shown in FIG. 1. Load securing and release system 10 comprises load carrying elongated web element 12 which is preferably a double braided nylon rope. End section 16 defines first receiving structure 20, which may be a large eye spliced into the end of the double braided rope. Other end section 14 defines series 22 of terminal (distal) receiving structures 23–25, which in this embodiment are loops formed or spliced into the web. As shown, loops 23–25 are increasingly longer from the first to the last (distal). It is not a limitation of this invention that loops are used, or that a particular number of loops are used.

System 10 also includes a series 28 of intermediate engaging structures 29–31. These intermediate engaging structures are preferably formed from diverging intermediate portion 32 of web element 12. In this embodiment, engaging structures 29–31 are also loops formed in or spliced into the rope.

Each of the intermediate engaging structures 29–31 is engaged through one of terminal receiving structures 23–25. Also, intermediate engaging structures 29 and 30 are engaged with another intermediate engaging structure. As shown in the drawings, engaging structure 29 is engaged with engaging structure 30, while engaging structure 30 is engaged with engaging structure 31. Engaging structure 31 is releasably held to the web element by release element 34, which is connected directly to section 14 rather than to intermediate diverging portion 32.

Terminal receiving structures 23–25, when placed parallel to each other in a common plane as shown in the drawing, preferably form a steep angle between the line drawn through their ends and a line normal to the vertical. When the receiving structures, engaging structures, and release element are received in each other in the manner shown in the drawing, they create a substantial mechanical advantage. This advantage is doubled by loop 34. A secondary (and potentially additional) multiplier loop could be added to increase the advantage by a factor of 4. For example, a second multiplier loop above loop 34 and separately directly connected to section 14, could engage through loop 34 and be connected to cord 37 in place of loop 34's connection to cord 37. This would further double the mechanical advantage of the system.

Sacrifice cord 37 is secured between multiplier loop 34 and anchor loop 36. To initiate the opening or activation of the system and thus release the load (which is typically attached around point 18), sacrifice cord 37 is cut by some means. Once this is severed, loop 34 releases loop 31, and the six interlocking spliced loops 23–25 and 29–31 disconnect from each other one at a time, and then slip through receiving structure 20 to release the load from point 18.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A load securing and release system, comprising:

a load carrying elongated web element having two end sections;

one end section defining a first receiving structure; and the other end section engaged through the first receiving structure and releasably connected on itself by a series of terminal receiving structures, and a series of intermediate engaging structures, wherein one engaging structure is engaged through each terminal receiving structure, and wherein all but one of the engaging structures is also releasably engaged with another engaging structure, and wherein the remaining engaging structure is releasably held to the web element by a release element, to provide a mechanical advantage for carrying heavy loads.

2. The load securing and release system of claim 1 wherein the first receiving structure comprises a loop in the web element.

3. The load securing and release system of claim 1 wherein the terminal receiving structures each comprise a loop in the web element.

4. The load securing and release system of claim 1 wherein the intermediate engaging structures each comprise a loop in the web element.

5. The load securing and release system of claim 1 wherein the release element comprises a loop.

6. The load securing and release system of claim 5 wherein the release element loop is engaged through the remaining engaging structure.

7. The load securing and release system of claim 6 wherein the release element loop is directly connected to the web element to increase the mechanical advantage of the system.

8. The load securing and release system of claim 7 wherein the release element further comprises an anchor loop engaged with the web element and a sacrifice cord connecting the anchor loop and the release element loop.

9. The load securing and release system of claim 8 further including one or more further mechanical advantage-increasing loops directly connected to the web element and between the release element loop and the sacrifice cord.

10. The load securing and release system of claim 1 wherein the terminal receiving structures are of gradually increasing length from the first to the distal terminal receiving structure.

11. The load securing and release system of claim 1 wherein the intermediate engaging structures are all part of a diverging portion of the web element.

12. The load securing and release system of claim 11 wherein the intermediate engaging structures each comprise a loop in the diverging portion.

13. The load securing and release system of claim 1 wherein there are three terminal receiving structures and three intermediate engaging structures.

14. A load securing and release system, comprising:

a load carrying elongated web element having two end sections;

one end section defining a first receiving structure comprising a loop in the web element; and the other end section engaged through the first receiving structure loop and releasably connected on itself by a series of terminal receiving structures each comprising a loop in the web element and wherein the terminal receiving structures are of gradually increasing length from the first to the distal terminal receiving structure, and a series of intermediate engaging structures each comprising a loop in the web element wherein the intermediate engaging structures each comprise a loop in the diverging portion that are all part of a diverging portion of the web element, wherein one engaging structure is engaged through each terminal receiving structure, and wherein all but one of the engaging structures is also releasably engaged with another engaging structure, and wherein the remaining engaging structure is releasably held to the web element by a release element that comprises a loop in the web element that is engaged through the remaining engaging structure, and wherein the release element further comprises an anchor loop engaged with the web element and a sacrifice cord connecting the anchor loop and the release element loop, to provide a mechanical advantage for carrying heavy loads.

* * * * *